US009243826B2

(12) United States Patent
Kawano et al.

(10) Patent No.: US 9,243,826 B2
(45) Date of Patent: Jan. 26, 2016

(54) REFRIGERATION CYCLE USING A REFRIGERANT HAVING NEGATIVE SATURATED VAPOR PRESSURE WITH CONDENSATION PATH BACKFLOW CONTROL AND REFRIGERATION CYCLE USING A REFRIGERANT HAVING NEGATIVE SATURATED VAPOR PRESSURE WITH EVAPORATION PATH LOAD BYPASS

(71) Applicant: Panasonic Corporation, Kadoma-shi, Osaka (JP)

(72) Inventors: Bunki Kawano, Osaka (JP); Tomoichiro Tamura, Osaka (JP); Kou Komori, Nara (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 196 days.

(21) Appl. No.: 14/004,033

(22) PCT Filed: Jan. 18, 2013

(86) PCT No.: PCT/JP2013/000240
§ 371 (c)(1),
(2) Date: Sep. 9, 2013

(87) PCT Pub. No.: WO2013/108637
PCT Pub. Date: Jul. 25, 2013

(65) Prior Publication Data

US 2014/0053595 A1 Feb. 27, 2014

(30) Foreign Application Priority Data

Jan. 20, 2012 (JP) ..... 2012-009541

(51) Int. Cl.
*F25B 41/00* (2006.01)
*F25B 49/00* (2006.01)
*F25B 43/00* (2006.01)

(Continued)

(52) U.S. Cl.
CPC ..... *F25B 41/003* (2013.01); *F25B 43/006* (2013.01); *F25B 1/04* (2013.01); *F25B 1/10* (2013.01); *F25B 2400/072* (2013.01); *F25B 2400/16* (2013.01)

(58) Field of Classification Search
CPC ..... F25B 1/10; F25B 41/04; F25B 1/00; F25B 2400/13; F25B 2600/2501; F25B 2400/23; F25B 2400/16; F25B 41/003; F25B 39/04
USPC ..... 62/196.3, 498
See application file for complete search history.

(56) References Cited

U.S. PATENT DOCUMENTS 6,481,242 B2 11/2002 Shirakata et al.
6,672,099 B1 1/2004 Yoshimi et al.

(Continued)

FOREIGN PATENT DOCUMENTS

CN 1218152 9/2005
CN 1789865 6/2006

(Continued)

OTHER PUBLICATIONS

Machine Translation of JP 2008-164187 Imai, "Air Conditioning Device Utilizing Groundwater", PAJ, Jan. 17, 2008, all.*
Search Report issued Jun. 30, 2015 in corresponding Chinese patent application and English translation, 3 pages total.

*Primary Examiner* — Allen Flanigan
*Assistant Examiner* — Filip Zec
(74) *Attorney, Agent, or Firm* — Hamre, Schumann, Mueller & Larson, P.C.

(57) ABSTRACT

A refrigeration cycle apparatus (1A) includes: an evaporator (23) that retains a refrigerant liquid and that evaporates the refrigerant liquid therein; a condenser (22) that condenses a refrigerant vapor therein and that retains the refrigerant liquid; a vapor channel (2A) that is provided with a compressor (21) and that directs the refrigerant vapor from the evaporator (23) to the condenser (22); a liquid channel (2B) that directs the refrigerant liquid from the condenser (22) to the evaporator (23); a condensation-side circulation path (4) that allows the refrigerant liquid retained in the condenser (22) to circulate via a heat exchanger for heat release (41) and that is provided with a condensation-side pump (45) at a position upstream of the heat exchanger for heat release (41); and a back-flow path (7) that directs a portion of the refrigerant liquid flowing in a section downstream of the heat exchanger for heat release (41) in the condensation-side circulation path (4) to a section upstream of the condensation-side pump (41) in the condensation-side circulation path (4) or to a bottom of the condenser (22).

4 Claims, 5 Drawing Sheets

(51) Int. Cl.
*F25B 1/04* (2006.01)
*F25B 1/10* (2006.01)

(56) References Cited

U.S. PATENT DOCUMENTS

| | | | | |
|---|---|---|---|---|
| 6,755,043 | B2 * | 6/2004 | Jensen et al. | 62/268 |
| 8,051,669 | B2 * | 11/2011 | Imai et al. | 62/196.3 |
| 2006/0150667 | A1 | 7/2006 | Lee et al. | |

FOREIGN PATENT DOCUMENTS

| | | |
|---|---|---|
| JP | 2001-074322 | 3/2001 |
| JP | 2002-061970 | 2/2002 |
| JP | 2002-372397 | 12/2002 |
| JP | 2008-164187 | 7/2008 |
| JP | 2008-232480 | 10/2008 |
| JP | 4454456 | 2/2010 |
| JP | 2010-230266 | 10/2010 |

* cited by examiner

REFRIGERATION CYCLE USING A REFRIGERANT HAVING NEGATIVE SATURATED VAPOR PRESSURE WITH CONDENSATION PATH BACKFLOW CONTROL AND REFRIGERATION CYCLE USING A REFRIGERANT HAVING NEGATIVE SATURATED VAPOR PRESSURE WITH EVAPORATION PATH LOAD BYPASS

TECHNICAL FIELD

The present invention relates to a refrigeration cycle apparatus.

BACKGROUND ART

Conventionally, refrigeration cycle apparatuses in which a chlorofluorocarbon or an alternative chlorofluorocarbon is used as a refrigerant are widely used. However, such refrigerants are responsible for the problems such as ozone depletion and global warming. In view of this, refrigeration cycle apparatuses have been proposed in which water is used as a refrigerant that places only an extremely small load on the global environment. As an example of such a refrigeration cycle apparatus, Patent Literature 1 discloses a refrigeration cycle apparatus 100 as shown in FIG. 5.

The refrigeration cycle apparatus 100 has a refrigerant circuit 110 composed of an evaporator 111, a compressor 112, and a condenser 113 which are connected in this order. Water is retained in the evaporator 111 and the condenser 113. The water retained in the evaporator 111 is circulated via a low temperature-side load unit 121 by a circulation path for heat absorption 120. The water retained in the condenser 113 is circulated via a high temperature-side load unit 131 by a circulation path for heat release 130. The circulation paths 120 and 130 are provided with pumps 122 and 132, respectively. The compressor 112 draws water vapor from the evaporator 111, compresses the water vapor, and discharges the compressed water vapor to the condenser 113.

In the case of using water as a refrigerant as in the refrigeration cycle apparatus 100 of Patent Literature 1, the difference between a high-pressure-side pressure $P_c$ and a low-pressure-side pressure $P_e$ is reduced due to the physical properties of water, compared to the case of a refrigeration cycle in which a chlorofluorocarbon or an alternative chlorofluorocarbon is used as a refrigerant. Accordingly, the use of water as a refrigerant has a problem in that a high-precision expansion valve and complicated control of the valve are needed. In order to address this problem, the refrigeration cycle apparatus 100 described in Patent Literature 1 eliminates the need for a high-precision expansion valve and complicated control of the valve by being configured to ensure a predetermined difference between the high-pressure-side pressure $P_c$ and the low-pressure-side pressure $P_e$ by means of a level difference $\Delta h$ between a water level in the evaporator 111 and a water level in the condenser 113. This can make it easy to control a system using water as a refrigerant, resulting in improvement in the reliability of a refrigeration cycle apparatus.

CITATION LIST

Patent Literature

Patent Literature 1: JP Patent No. 4454456

SUMMARY OF INVENTION

Technical Problem

However, the refrigeration cycle apparatus 100 of Patent Literature 1 has room for size reduction of the apparatus.

In view of the above circumstances, the present disclosure has the object of achieving size reduction of a refrigeration cycle apparatus that uses a refrigerant, such as water, whose saturated vapor pressure is a negative pressure at ordinary temperature (20° C.±15° C.: Japanese Industrial Standards (JIS) Z 8703).

Solution to Problem

In order to achieve the above object, the present disclosure provides a refrigeration cycle apparatus using a refrigerant whose saturated vapor pressure is a negative pressure at ordinary temperature, including: an evaporator that retains a refrigerant liquid and that evaporates the refrigerant liquid therein; a condenser that condenses a refrigerant vapor therein and that retains the refrigerant liquid; a vapor channel that is provided with a compressor and that directs the refrigerant vapor from the evaporator to the condenser; a liquid channel that directs the refrigerant liquid from the condenser to the evaporator; a condensation-side circulation path that allows the refrigerant liquid retained in the condenser to circulate via a heat exchanger for heat release and that is provided with a condensation-side pump at a position upstream of the heat exchanger for heat release; and a backflow path that directs a portion of the refrigerant liquid flowing in a section downstream of the heat exchanger for heat release in the condensation-side circulation path to a section upstream of the condensation-side pump in the condensation-side circulation path or to a bottom of the condenser.

Advantageous Effects of Invention

According to the present disclosure, the size of a refrigeration cycle apparatus can be reduced.

DESCRIPTION OF EMBODIMENTS

Figure 1:
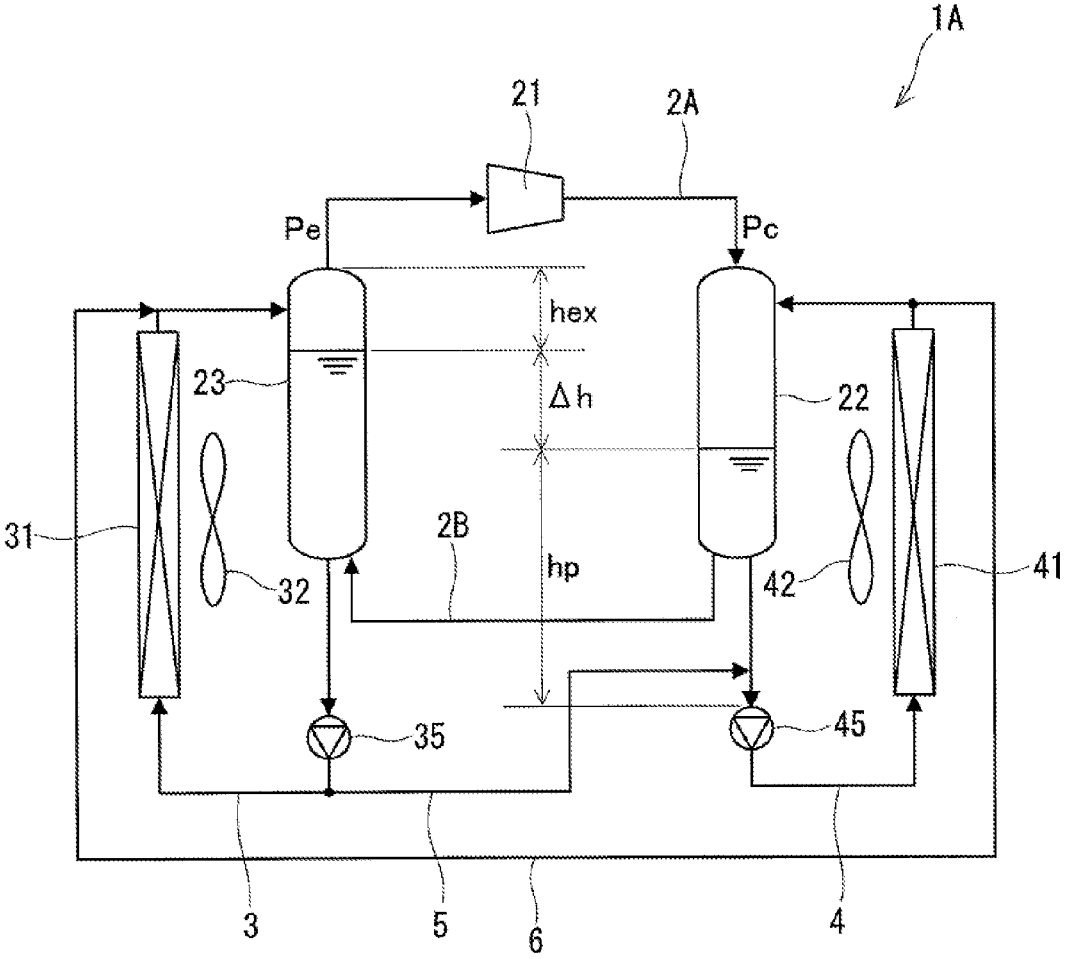
FIG. 1 is a configuration diagram of a refrigeration cycle apparatus according to a first embodiment of the present invention.

In the refrigeration cycle apparatus 100 of Patent Literature 1, the water level in the condenser 113 is lower than the water level in the evaporator 111 due to the difference between the high-pressure-side pressure $P_c$ and the low-pressure-side pressure $P_e$. Accordingly, the overall height of the refrigeration cycle apparatus 100 is determined basically by the sum of the available net positive suction head (available NPSH) $h_p$ of the pump 132 located on the condenser 113 side, the aforementioned level difference Δh, and a height hex required to secure an area necessary for water evaporation in the evaporator 111. Therefore, when the water level in the condenser 113 is set at a level sufficient for preventing cavitation in the pump 132 (i.e., when the available net positive suction head $h_p$ of the pump 132 is set sufficiently higher than the required net positive suction head (required NPSH) of the pump 132), the size of the refrigeration cycle apparatus 100 is significantly increased.

A first aspect of the present disclosure provides a refrigeration cycle apparatus using a refrigerant whose saturated vapor pressure is a negative pressure at ordinary temperature, including: an evaporator that retains a refrigerant liquid and that evaporates the refrigerant liquid therein; a condenser that condenses a refrigerant vapor therein and that retains the refrigerant liquid; a vapor channel that is provided with a compressor and that directs the refrigerant vapor from the evaporator to the condenser; a liquid channel that directs the refrigerant liquid from the condenser to the evaporator; a condensation-side circulation path that allows the refrigerant liquid retained in the condenser to circulate via a heat exchanger for heat release and that is provided with a condensation-side pump at a position upstream of the heat exchanger for heat release; and a back-flow path that directs a portion of the refrigerant liquid flowing in a section downstream of the heat exchanger for heat release in the condensation-side circulation path to a section upstream of the condensation-side pump in the condensation-side circulation path or to a bottom of the condenser.

According to the first aspect, a portion of the refrigerant liquid cooled in the heat exchanger for heat release is mixed with the high-temperature refrigerant liquid drawn into the condensation-side pump from the condenser. This can reduce the required net positive suction head of the condensation-side pump. Consequently, cavitation in the condensation-side pump can be prevented even when the available net positive suction head of the condensation-side pump is reduced, which allows size reduction of the refrigeration cycle apparatus.

A second aspect of the present disclosure provides the refrigeration cycle apparatus as set forth in the first aspect, further including a flow rate control valve that is provided in the back-flow path and that controls a flow rate of the refrigerant liquid flowing in the back-flow path. According to the second aspect, the flow rate of the refrigerant liquid in the back-flow path can be appropriately controlled.

A third aspect of the present disclosure provides a refrigeration cycle apparatus using a refrigerant whose saturated vapor pressure is a negative pressure at ordinary temperature, including: an evaporator that retains a refrigerant liquid and that evaporates the refrigerant liquid therein; a condenser that condenses a refrigerant vapor therein and that retains the refrigerant liquid; a vapor channel that is provided with a compressor and that directs the refrigerant vapor from the evaporator to the condenser; a liquid channel that directs the refrigerant liquid from the condenser to the evaporator; an evaporation-side circulation path that allows the refrigerant liquid retained in the evaporator to circulate via a heat exchanger for heat absorption and that is provided with an evaporation-side pump at a position upstream of the heat exchanger for heat absorption; a condensation-side circulation path that allows the refrigerant liquid retained in the condenser to circulate via a heat exchanger for heat release and that is provided with a condensation-side pump at a position upstream of the heat exchanger for heat release; a first bypass path that directs a portion of the refrigerant liquid flowing in a section between the evaporation-side pump and the heat exchanger for heat absorption in the evaporation-side circulation path to a section upstream of the condensation-side pump in the condensation-side circulation path or to a bottom of the condenser; and a second bypass path that directs a portion of the refrigerant liquid flowing in a section downstream of the heat exchanger for heat release in the condensation-side circulation path to a section downstream of the heat exchanger for heat absorption in the evaporation-side circulation path or to the evaporator.

According to the third aspect, a portion of the low-temperature refrigerant liquid drawn from the evaporator is mixed with the high-temperature refrigerant liquid drawn into the condensation-side pump from the condenser. This can reduce the required net positive suction head of the condensation-side pump. Consequently, cavitation in the condensation-side pump can be prevented even when the available net positive suction head of the condensation-side pump is reduced, which allows size reduction of the refrigeration cycle apparatus. Furthermore, a portion of the refrigerant liquid having passed through the heat exchanger for heat release returns to the evaporation-side circulation path via the second bypass path. Therefore, exhaustion of the refrigerant liquid from the evaporator can be prevented.

A fourth aspect of the present disclosure provides the refrigeration cycle apparatus as set forth in the third aspect, further including: a first flow rate control valve that is provided in the first bypass path and that controls a flow rate of the refrigerant liquid flowing in the first bypass path; and a second flow rate control valve that is provided in the second bypass path and that controls a flow rate of the refrigerant liquid flowing in the second bypass path. According to the third aspect, the flow rates of the refrigerant liquid in the first bypass path and in the second bypass path can be appropriately controlled.

Hereinafter, embodiments of the present invention will be described with reference to the drawings. However, the present invention is not limited by the embodiments described below.

First Embodiment

A refrigeration cycle apparatus 1A of the present embodiment is shown in FIG. 1. The refrigeration cycle apparatus 1A uses a refrigerant whose main component is water or an alcohol, and includes two vacuum containers that respectively function as an evaporator 23 and a condenser 22. The pressure in each vacuum container is a negative pressure lower than an atmospheric pressure. The refrigerant that can be used in the refrigerant cycle apparatus 1A is a refrigerant whose saturated vapor pressure is a negative pressure (a pressure that is lower than an atmospheric pressure in terms of absolute pressure) at ordinary temperature, such as a refrigerant containing water, an alcohol, or an ether as a main component.

The evaporator 23 and the condenser 22 are connected to each other by a vapor channel 2A and a liquid channel 2B. The evaporator 23 retains a refrigerant liquid, and evaporates the refrigerant liquid therein. The condenser 22 condenses a refrigerant vapor therein, and retains the refrigerant liquid. The vapor channel 2A directs the refrigerant vapor from the evaporator 23 to the condenser 22, and the liquid channel 2B directs the refrigerant liquid from the condenser 22 to the evaporator 23. The vapor channel 2A is provided with a compressor 21 that draws, compresses, and discharges the refrigerant vapor. That is, the vapor channel 2A and the liquid channel 2B form a main circuit that allows the refrigerant to circulate through the evaporator 23, the compressor 21, and the condenser 22 in this order.

The compressor 21 is, for example, a centrifugal compressor capable of operating even at high pressure ratio. The compressor 21 may be a positive-displacement compressor or a multistage compressor. In addition, a system including an intercooling means that is provided between compression stages of a multistage compressor to cool the refrigerant vapor can also be used as the compressor 21. A direct contact heat exchanger or an indirect heat exchanger can be used as the intercooling means.

The condenser 22 is a heat exchanger that condenses the superheated refrigerant vapor discharged from the compressor 2 by bringing the refrigerant vapor into direct contact with the refrigerant liquid suprecooled in a heat exchanger for heat release 41 described later. The condenser 22 may be a shell-and-tube heat exchanger conventionally used in a refrigeration cycle apparatus. A portion of the refrigerant liquid resulting from condensation in the condenser 22 is introduced into the evaporator 23 via the liquid channel 2B.

The evaporator 23 is a heat exchanger that allows the refrigerant liquid heated in a heat exchanger for heat absorption 31 described later to be boiled under a reduced pressure. The condenser 23 may be a shell-and-tube heat exchanger used in a refrigeration cycle apparatus of conventional art.

A first circulation path (evaporation-side circulation path) 3 and a second circulation path (condensation-side circulation path) 4 are connected to the evaporator 23 and the condenser 22, respectively. The first circulation path 3 allows the refrigerant liquid retained in the evaporator 23 to circulate via the heat exchanger for heat absorption 31, and the second circulation path 4 allows the refrigerant liquid retained in the condenser 22 to circulate via the heat exchanger for heat release 41. The first circulation path 3 is provided with a first pump (evaporation-side pump) 35 at a position upstream of the heat exchanger for heat absorption 31, and the second circulation path 4 is provided with a second pump (condensation-side pump) 45 at a position upstream of the heat exchanger for heat release 41.

The first pump 35 and the second pump 45 are each a pump that is able to control flow rate in response to the operating condition by adjustment of its number of revolutions. The first pump 35 and the second pump 45 are placed lower than the evaporator 23 and the condenser 22 so that the available net positive suction head (height from the suction port to the liquid level) is sufficiently higher than the required net positive suction head to prevent, for example, generation of cavitation.

The heat exchanger for heat absorption 31 is, for example, a fin-tube heat exchanger equipped with an air blower 32. For example, in the case where the refrigeration cycle apparatus 1A is an air conditioner for cooling an indoor space, the heat exchanger for heat absorption 31 is placed in the indoor space, and allows indoor air supplied by the air blower 32 to be cooled through heat exchange with the refrigerant liquid. The heat exchanger for heat absorption 31 may be a thermal load unit, such as a radiant panel, which is conventionally used in a refrigeration cycle apparatus.

The heat exchanger for heat release 41 is, for example, a fin-tube heat exchanger equipped with an air blower 42. For example, in the case where the refrigeration cycle apparatus 1A is an air conditioner for cooling an indoor space, the heat exchanger for heat release 41 is placed outside the indoor space, and allows outdoor air supplied by the air blower 42 to be heated through heat exchange with the refrigerant liquid. The heat exchanger for heat release 41 may be a thermal load unit, such as a cooling tower or a radiant panel, which is conventionally used in a refrigeration cycle apparatus.

The refrigeration cycle apparatus 1A need not necessarily be an air conditioner specialized for cooling. For example, when a first heat exchanger placed in an indoor space and a second heat exchanger placed outside the indoor space are connected to the evaporator 23 and the condenser 22 via four-way valves, an air conditioner capable of switching between cooling operation and heating operation can be obtained. In this case, both the first heat exchanger and the second heat exchanger function as the heat exchanger for heat absorption 31 and the heat exchanger for heat release 41. In addition, the refrigeration cycle apparatus 1A need not necessarily be an air conditioner, and may be, for example, a chiller. Furthermore, the object to be cooled in the heat exchanger for heat absorption 31 and the object to be heated in the heat exchanger for heat release 41 may be a gas other than air or a liquid. In other words, the types of the heat exchanger for heat absorption 31 and the heat exchanger for heat release 41 are not particularly limited as long as they are indirect heat exchangers.

Furthermore, in the refrigeration cycle apparatus 1A of the present embodiment, the first circulation path 3 and the second circulation path 4 are connected to each other by a first bypass path 5 and a second bypass path 6.

The first bypass path 5 is branched from a section between the first pump 35 and the heat exchanger for heat absorption 31 in the first circulation path 3 (the section will be referred to as an "intermediate section" hereinafter), and is connected to a section upstream of the second pump 45 in the second circulation path 4 (the section will be referred to as an "upstream section" hereinafter). The pressure at a position at which the first bypass path 5 is branched from the first circulation path 3 is higher than the pressure at a position at which the first bypass path 5 is connected to the second circulation path 4. Therefore, in the first bypass path 5, the refrigerant liquid flows only in a direction from the first circulation path 3 to the second circulation path 4. That is, the first bypass path 5 directs a portion of the refrigerant liquid flowing in the intermediate section of the first circulation path 3 to the upstream section of the second circulation path 4. In other words, after the refrigerant liquid fed from the evaporator 23 is increased in pressure by the first pump 35, the refrigerant liquid is divided into a portion flowing to the heat exchanger for heat absorption 31 and a portion flowing to the second pump 45 via the second circulation path 4.

The upstream section includes a section inside the casing of the second pump 45, the section being located upstream of a section in which the second pump 45 applies pressure to the refrigerant liquid. For example, in the case where the second pump 45 is a turbo pump, the upstream section means a section upstream of the upstream end of a rotary impeller provided inside the casing of the second pump 45. In the case where the second pump 45 is a turbo pump, the first bypass path 5 may be connected to the casing of the second pump 45 at a position upstream of the upstream end of the rotary impeller of the second pump 45.

The second bypass path 6 is branched from a section downstream of the heat exchanger for heat release 41 in the second circulation path 4 (the section will be referred to as a "downstream section" hereinafter), and is connected to a section downstream of the heat exchanger for heat absorption 31 in the first circulation path 3 (the section will be referred to as a "downstream section" hereinafter). The pressure in the condenser 22 is higher than the pressure in the evaporator 23. Therefore, in the second bypass path 6, the refrigerant liquid flows only in a direction from the second circulation path 4 to the first circulation path 3. That is, the second bypass path 6 directs a portion of the refrigerant liquid flowing in the downstream section of the second circulation path 4 to the downstream section of the first circulation path 3. In other words, the refrigerant liquid having released heat in the heat exchanger for heat release 41 is divided into a portion flowing to the condenser 22 and a portion flowing to the evaporator 23 via the first circulation path 3.

The second bypass path 6 is preferably designed so that the refrigerant liquid flows in the second bypass path 6 at approximately the same flow rate as in the first bypass path 5. However, the second bypass path 6 may be designed so that the mass flow rate in the second bypass path 6 is equal to the sum of the mass flow rate in the first bypass path 5 and the mass flow rate in the vapor channel 2A provided with the compressor 21. In this case, the liquid channel 2B can be omitted.

For example, the rated flow of the second pump 45 located on the condenser 22 side is 60 L/min, and the first bypass path 5 is designed so that the refrigerant liquid flows in the first bypass path 5 at a flow rate of 1 L/min when the second pump 45 is in rated operation. In this case, assuming that the temperature of the refrigerant liquid in the evaporator 23 is 281.35 K and the temperature of the refrigerant liquid in the condenser 22 is 316.85 K, the temperature of the refrigerant liquid at the impeller end at which cavitation in the second pump 45 is most likely to be generated can be lowered to about 310 K. Consequently, the required net positive suction head can be reduced by 0.346 m.

According to the refrigeration cycle apparatus 1A of the present embodiment, the required net positive suction head of the second pump 45 located on the condenser 22 side can be significantly reduced. Therefore, it is possible to reduce the size of the refrigeration cycle apparatus 1A while ensuring its reliability.

Modification

Figure 2:
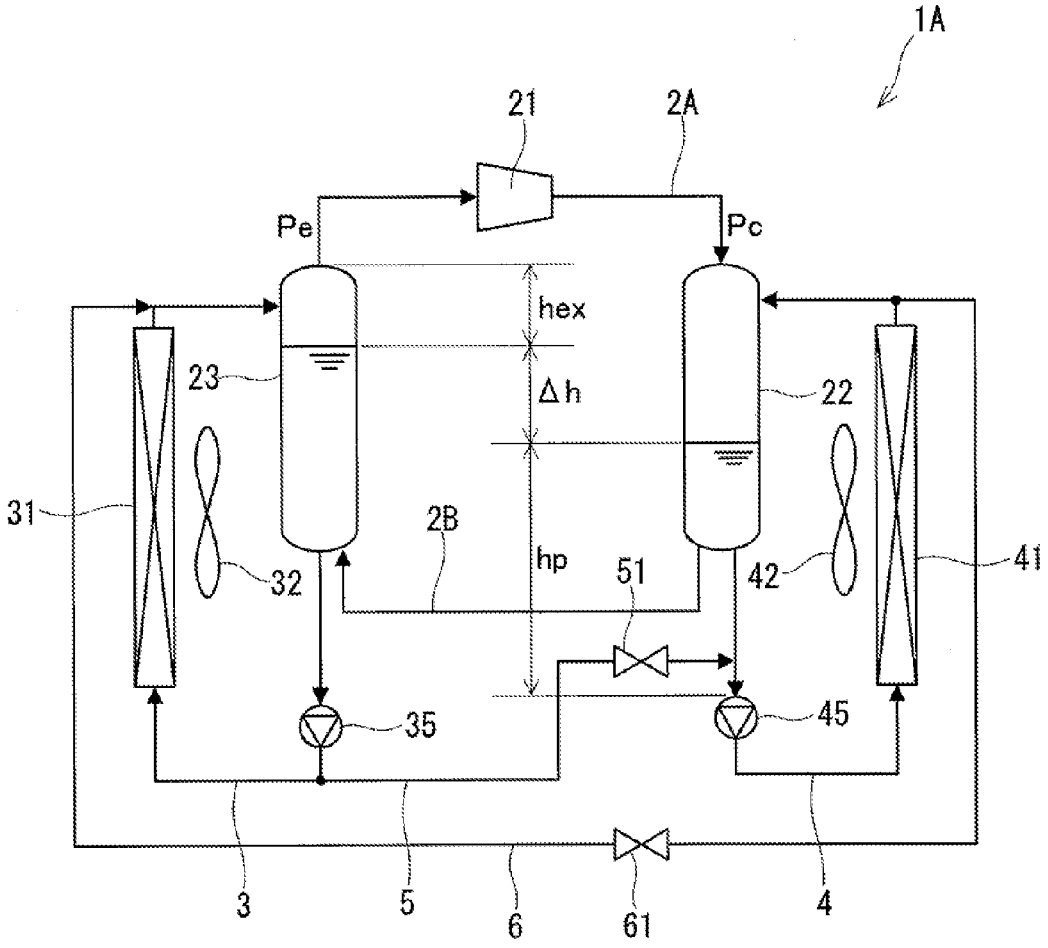
FIG. 2 is a configuration diagram of a refrigeration cycle apparatus of an example of modification of the first embodiment.

In the above embodiment, the flow rates of the refrigerant liquid flowing in the first bypass path 5 and in the second bypass path 6 are determined by specification values of the first bypass path 5 and the second bypass path 6, and cannot be managed in accordance with the operation condition. However, it is preferable that, as shown in FIG. 2, a first flow rate control valve 51 that controls the flow rate of the refrigerant liquid flowing in the first bypass path 5 be provided in the first bypass path 5, and a second flow rate control valve 61 that controls the flow rate of the refrigerant liquid flowing in the second bypass path 6 be provided in the second bypass path 6. In this case, the flow rates in the first bypass path 5 and the second bypass path 6 can be controlled in an optimum manner, with the result that improvement in system performance and further prevention of cavitation in the second pump 45 can be achieved.

The opening degrees of the first flow rate control valve 51 and the second flow rate control valve 61 are preferably adjusted so that the flow rate of the refrigerant liquid flowing in the first bypass path 5 and the flow rate of the refrigerant liquid flowing in the second bypass path 6 are equal to each other. For example, the opening degrees of the flow rate control valves 51 and 61 are adjusted to the same value in accordance with the number of revolutions of the second pump 45 as shown in Table 1. Alternatively, the opening degrees of the flow rate control valves 51 and 61 may be adjusted in accordance with the flow rate of the second pump 45 as shown in Table 2, or may be adjusted in accordance with the pressure at the suction port of the second pump 45 as shown in Table 3.

TABLE 1

| | Number of revolutions of pump [rpm] | | | | |
|---|---|---|---|---|---|
| | 1000 | 1500 | 2000 | 2500 | 3000 |
| Opening degree of valve [%] | 20 | 40 | 60 | 80 | 100 |

TABLE 2

| | Flow rate of pump [L/min] | | | | |
|---|---|---|---|---|---|
| | 10 | 20 | 30 | 40 | 60 |
| Opening degree of valve [%] | 20 | 40 | 60 | 80 | 100 |

TABLE 3

| | Pressure at suction port [kPa] | | | | |
|---|---|---|---|---|---|
| | 13 | 18 | 25 | 37 | 55 |
| Opening degree of valve [%] | 20 | 40 | 60 | 80 | 100 |

In addition, in the previously-described embodiment, the downstream end of the first bypass path 5 is connected to the upstream section of the second circulation path 4. However, the downstream end of the first bypass path 5 may be connected to the bottom of the condenser 22, and the refrigerant liquid may be directed to the bottom of the condenser 22 by the first bypass path 5. Here, the bottom of the condenser 22 means a part of the condenser 22 that is located lower than the lowest possible liquid level in the condenser 22. Even with such a configuration, the required net positive suction head of the second pump 45 can be reduced, although the effect is slightly smaller than in the previously-described embodiment.

In addition, the downstream end of the second bypass path 6 need not necessarily be connected to the downstream section of the first circulation path 3, and may be connected to the evaporator 23. In this case, the refrigerant liquid is directed to the evaporator 23 by the second bypass path 6.

Second Embodiment

Figure 3:
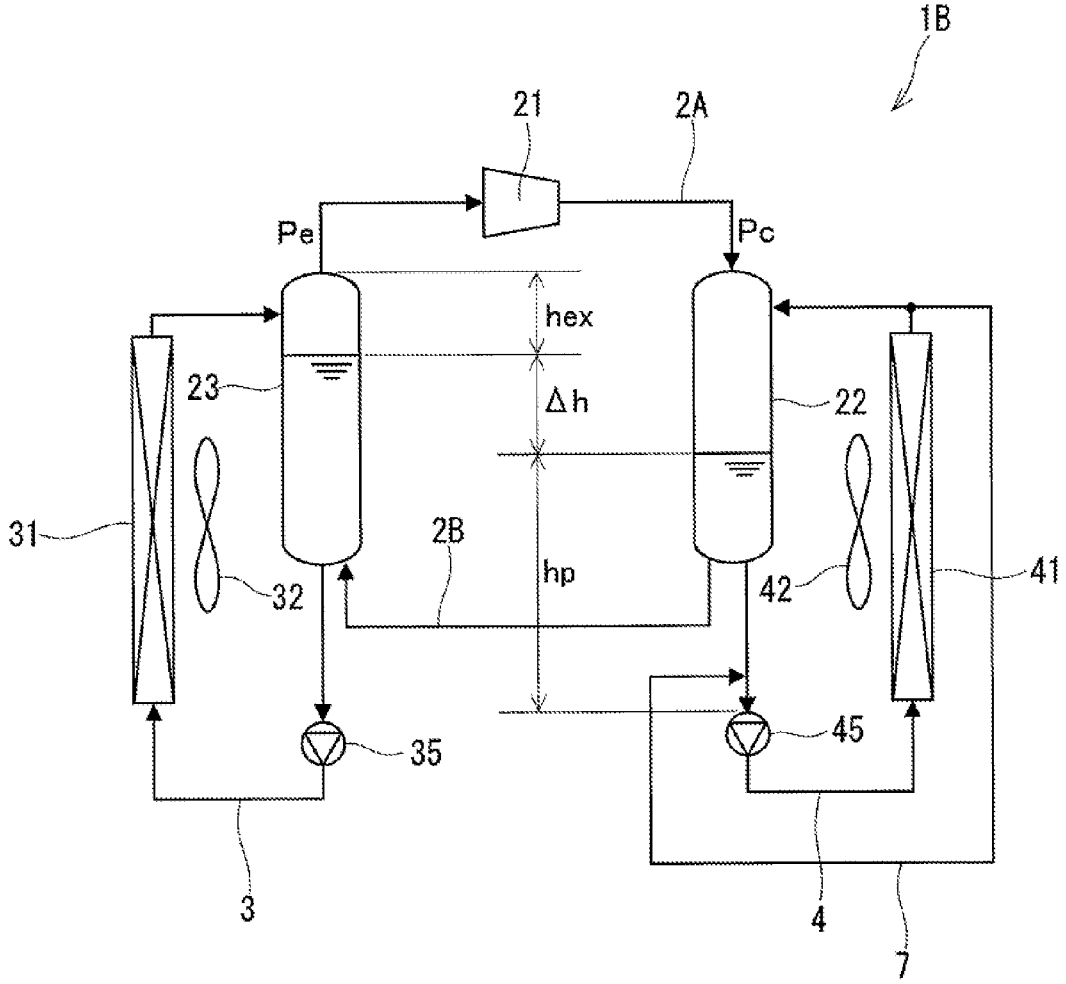
FIG. 3 is a configuration diagram of a refrigeration cycle apparatus according to a second embodiment of the present invention.

A refrigeration cycle apparatus 1B of the present embodiment is shown in FIG. 3. In the present embodiment, the same components as those of the first embodiment are denoted by the same reference characters, and the description thereof is omitted in some cases.

In the refrigeration cycle apparatus 1B of the present embodiment, a back-flow path 7 branched from the downstream section of the second circulation path 4 and connected to the upstream section of the second circulation path 4 is provided instead of the first bypass path 5 and the second bypass path 6 in the refrigeration cycle apparatus 1A of the first embodiment. The back-flow path 7 directs a portion of the refrigerant liquid flowing in the downstream section of the second circulation path 4 to the upstream section of the second circulation path 4. As in the first embodiment, the upstream section of the second circulation path 4 includes a section inside the casing of the second pump 45, the section being located upstream of a section in which the second pump 45 applies pressure to the refrigerant liquid. In the case where the second pump 45 is a turbo pump, the back-flow path 7 may be connected to the casing of the second pump 45 at a position upstream of the upstream end of the rotary impeller of the second pump 45.

In the refrigeration cycle apparatus 1B of the present embodiment, the refrigerant liquid having released heat in the heat exchanger for heat release 41 is introduced into the second pump 45. Accordingly, the required net positive suction head of the second pump 45 located on the condenser 22 side can be significantly reduced as in the first embodiment. Therefore, it is possible to reduce the size of the refrigeration cycle apparatus 1B while ensuring its reliability.

In the present embodiment, the downstream end of the back-flow path 7 may be connected to the bottom of the condenser 22, and the refrigerant liquid may be directed to the bottom of the condenser 22 by the back-flow path 7. Here, the bottom of the condenser 22 means a part of the condenser 22 that is located lower than the lowest possible liquid level in the condenser 22.

Modification

Figure 4:
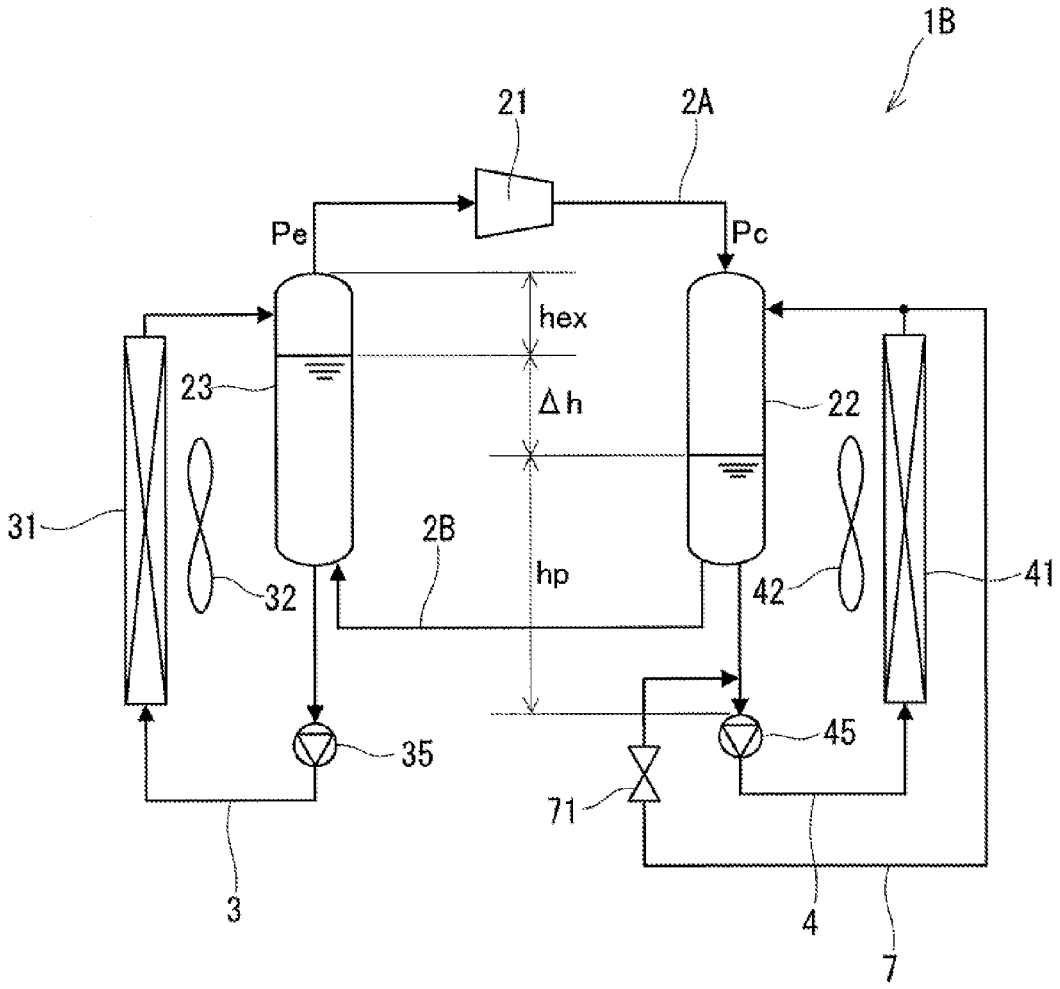
FIG. 4 is a configuration diagram of a refrigeration cycle apparatus of an example of modification of the second embodiment.
Figure 5:
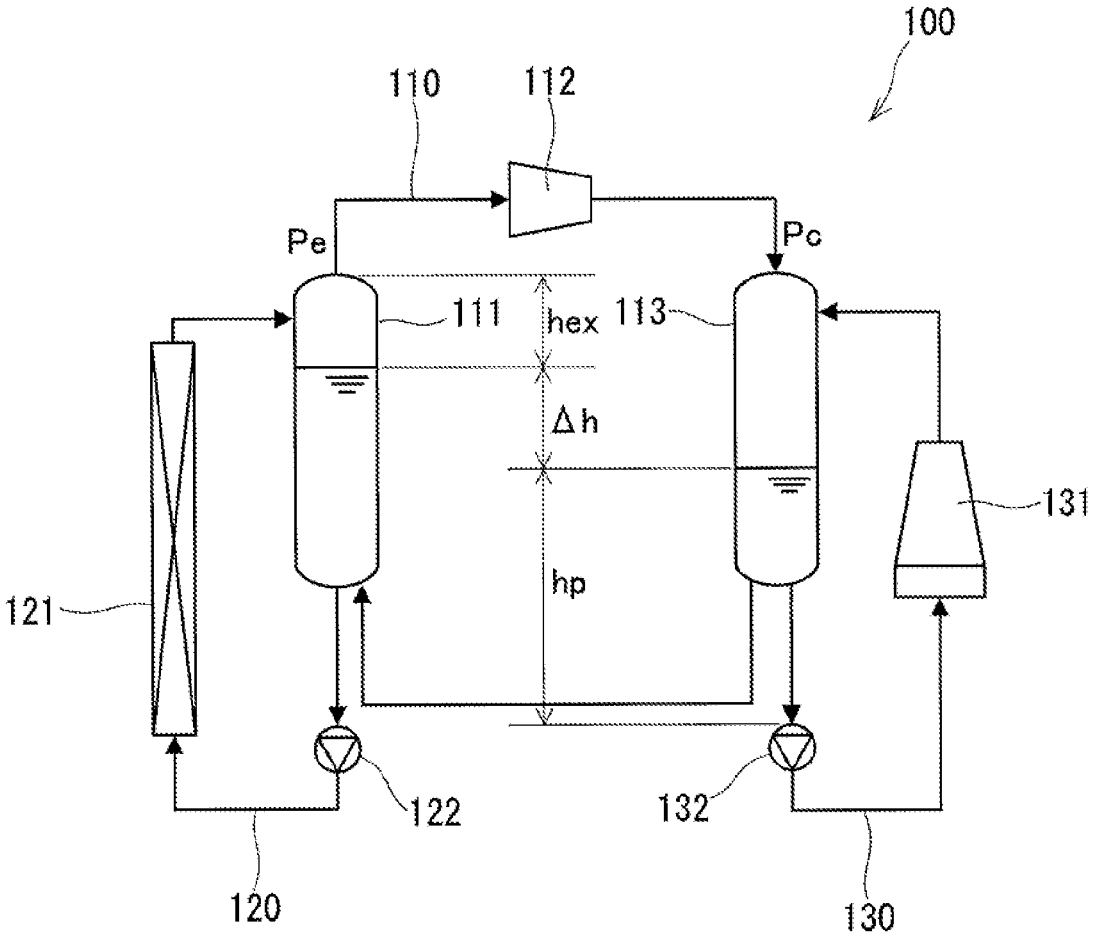
FIG. 5 is a configuration diagram of a conventional refrigeration cycle apparatus.

In the above embodiment, the flow rate of the refrigerant liquid flowing in the back-flow path 7 is determined by specification values of the back-flow path 7, and cannot be managed in accordance with the operation condition. However, it is preferable that, as shown in FIG. 4, a flow rate control valve 71 that controls the flow rate of the refrigerant liquid flowing in the back-flow path 7 be provided in the back-flow path 7. In this case, the flow rate in the back-flow path 7 can be controlled in an optimum manner, with the result that improvement in system performance and further prevention of cavitation in the second pump 45 can be achieved. The opening degree of the flow rate control valve 71 can be adjusted in the same manner as described for the example of modification of the first embodiment.

INDUSTRIAL APPLICABILITY

The refrigeration cycle apparatus of the present invention is useful for household air conditioners, industrial air conditioners, etc.

The invention claimed is:

1. A refrigeration cycle apparatus using a refrigerant whose saturated vapor pressure is a negative pressure at ordinary temperature, comprising:
- an evaporator that retains a refrigerant liquid and evaporates the refrigerant liquid therein;
- a condenser that condenses a refrigerant vapor therein and retains the refrigerant liquid;
- a vapor channel that is provided with a compressor and directs the refrigerant vapor from the evaporator to the condenser;
- a liquid channel that directs the refrigerant liquid from the condenser to the evaporator;
- a condensation-side circulation path that directs the refrigerant liquid retained in the condenser to circulate via a heat exchanger for heat release and is provided with a condensation-side pump at a position upstream of the heat exchanger for heat release; and
- a back-flow path that directs a portion of the refrigerant liquid flowing in a section downstream of the heat exchanger for heat release in the condensation-side circulation path to at least one of a section upstream of the condensation-side pump in the condensation-side circulation path and a bottom of the condenser, wherein an outlet of the back-flow path is connected to at least one of the section upstream of the condensation-side pump and the bottom of the condenser.

2. The refrigeration cycle apparatus according to claim 1, further comprising:
- a flow rate control valve provided in the back-flow path and controls a flow rate of the refrigerant liquid flowing in the back-flow path.

3. A refrigeration cycle apparatus using a refrigerant whose saturated vapor pressure is a negative pressure at ordinary temperature, comprising:
- an evaporator that retains a refrigerant liquid and evaporates the refrigerant liquid therein;
- a condenser that condenses a refrigerant vapor therein and retains the refrigerant liquid;
- a vapor channel that is provided with a compressor and directs the refrigerant vapor from the evaporator to the condenser;
- a liquid channel that directs the refrigerant liquid from the condenser to the evaporator;
- an evaporation-side circulation path that directs the refrigerant liquid retained in the evaporator to circulate via a heat exchanger for heat absorption and is provided with an evaporation-side pump at a position upstream of the heat exchanger for heat absorption;
- a condensation-side circulation path that directs the refrigerant liquid retained in the condenser to circulate via a heat exchanger for heat release and is provided with a condensation-side pump at a position upstream of the heat exchanger for heat release;
- a first bypass path that directs a portion of the refrigerant liquid flowing in a section between the evaporation-side pump and the heat exchanger for heat absorption in the evaporation-side circulation path to at least one of a section upstream of the condensation-side pump in the condensation-side circulation path and a bottom of the condenser, wherein an outlet of the first bypass path is connected to at least one of the section upstream of the condensation-side pump and the bottom of the condenser; and
- a second bypass path that directs a portion of the refrigerant liquid flowing in a section downstream of the heat exchanger for heat release in the condensation-side circulation path to at least one of a section downstream of the heat exchanger for heat absorption in the evaporation-side circulation path and the evaporator.

4. The refrigeration cycle apparatus according to claim 3, further comprising:
- a first flow rate control valve that is provided in the first bypass path and controls a flow rate of the refrigerant liquid flowing in the first bypass path; and
- a second flow rate control valve that is provided in the second bypass path and controls a flow rate of the refrigerant liquid flowing in the second bypass path.

* * * * *